US008650990B2

(12) United States Patent
Riestra

(10) Patent No.: US 8,650,990 B2
(45) Date of Patent: Feb. 18, 2014

(54) HAND-OPERATED HYDRAULIC WRENCH FOR HIGH TORQUE TIGHTENING AND LOOSENING

(75) Inventor: Antonio Cami Riestra, Lleida (ES)

(73) Assignees: Luis Gerardo Oyervides Ochoa, Nuevo Leon (MX); Antonio Cami Riestra, Lleida (ES)

( * ) Notice: Subject to any disclaimer, the term of this patent is extended or adjusted under 35 U.S.C. 154(b) by 750 days.

(21) Appl. No.: 12/949,903

(22) Filed: Nov. 19, 2010

(65) Prior Publication Data

US 2011/0203419 A1 Aug. 25, 2011

(30) Foreign Application Priority Data

Feb. 22, 2010 (MX) ..... MX/a/2010/002058

(51) Int. Cl.
*B25B 13/46* (2006.01)
*B25B 17/00* (2006.01)

(52) U.S. Cl.
USPC ..... 81/57.39; 81/57.44; 81/55; 81/57

(58) Field of Classification Search
USPC ..... 81/54, 57.39, 57.42, 57.44, 55
See application file for complete search history.

(56) References Cited

U.S. PATENT DOCUMENTS

| | | | | | |
|---|---|---|---|---|---|
| 1,913,003 | A * | 6/1933 | Shaff | 173/222 |
| 2,022,197 | A * | 11/1935 | Hampton | 91/234 |
| 2,086,261 | A * | 7/1937 | Douglass | 173/93 |
| 2,254,613 | A * | 9/1941 | Matthysse | 72/453.16 |
| 2,780,950 | A * | 2/1957 | Province | 81/57.44 |
| 2,871,743 | A * | 2/1959 | Kelley | 81/57.34 |
| 2,961,904 | A * | 11/1960 | Sergan | 81/60 |
| 3,269,223 | A * | 8/1966 | Pawloski | 81/487 |
| 3,445,913 | A * | 5/1969 | Piquerez | 29/807 |
| 3,739,659 | A * | 6/1973 | Workman, Jr. | 475/266 |
| 3,802,301 | A * | 4/1974 | Peterson | 81/468 |
| 4,794,825 | A * | 1/1989 | Schmoyer | 81/57.39 |
| 4,805,496 | A * | 2/1989 | Wagner et al. | 81/57.39 |
| 5,005,447 | A * | 4/1991 | Junkers | 81/57.39 |
| 5,095,780 | A * | 3/1992 | Beuke | 81/57.39 |
| 5,953,967 | A * | 9/1999 | Junkers et al. | 81/57.39 |
| 6,260,444 | B1 | 7/2001 | Junkers | |
| 7,082,858 | B2 | 8/2006 | Knopp et al. | |
| 8,365,754 | B2 * | 2/2013 | Riley et al. | 137/15.17 |
| 2002/0121161 | A1 | 9/2002 | Koppenhoefer | |
| 2005/0072275 | A1 * | 4/2005 | Sasaki et al. | 81/57.44 |
| 2006/0029502 | A1 * | 2/2006 | Kugelev et al. | 417/415 |
| 2006/0053981 | A1 * | 3/2006 | Shaw et al. | 81/57.39 |
| 2008/0289461 | A1 * | 11/2008 | Anson | 81/467 |
| 2012/0160065 | A1 * | 6/2012 | Frenken | 81/301 |

* cited by examiner

*Primary Examiner* — Monica Carter
*Assistant Examiner* — Melanie Alexander
(74) *Attorney, Agent, or Firm* — Birch, Stewart, Kolasch & Birch, LLP

(57) ABSTRACT

A hydraulic wrench for high-torque tightening/loosening which has two separate functions. The first function provides a manual wrench for performing tightening/loosening approximations which is accomplished by blocking of the bearing wrench regarding the a piston, the device becoming rigid as it was one single body. In the second function the hydraulic wrench serves as a tool performing high-torque tightening and loosening.

22 Claims, 10 Drawing Sheets

HAND-OPERATED HYDRAULIC WRENCH FOR HIGH TORQUE TIGHTENING AND LOOSENING

TECHNICAL FIELD OF THE INVENTION

Hydraulic drive wrenches for nuts in general may be of any shape and design, particularly in the area where the nut to be manipulated is placed. Nowadays, there is a great range of sizes and designs of nut flats and screw heads which are manufactured in this way to control their maneuvering and to achieve the adequate pressure for their tightening. The use of this type of wrenches is common in industry, as well as in daily life, where a nut is required to be unscrewed, loosened, screwed and tightened. The wrench of the present invention is a high torque wrench for every kind of nut which has the characteristic of not wearing down or damaging the edges of the screw heads.

BACKGROUND OF THE INVENTION

In the market, there is a wide variety of drive wrenches for nuts; for example, U.S. Pat. No. 7,082,858, which describes a hydraulic torque wrench having a separate ratchet unit and hydraulic cylinder drive unit connectable by an overlapping cylindrical connection at selected angles of rotation providing clearance in use. The hydraulic cylinder actuates the ratchet mechanism by a connecting rod traveling through the overlapping cylindrical connection and engaging a pivotable drive plate.

The ratchet unit case may be integral, or split for removable accesses to the ratchet mechanisms. The cylinder unit hydraulic connections may be separate rotatable connections or a single connection and collar, allowing three-way rotation, but having the disadvantage of not being autonomous and of depending on several connections in order to operate.

Another example is the invention described in document US 2002/0121161 A, which refers to a fluid-operated tool having a ratchet link assembly provided with ratcheting mechanism for engaging and turning a threaded connector, a fluid-operated drive assembly releasably connectable with the ratchet link assembly, and a unit for releasably connecting the fluid operated drive assembly with the ratchet link assembly, the connecting unit including an opening provided in one of the assembly, a projection provided in the other of the assemblies and insertable into the opening, and a blocking member which block the projection in the opening in an assembled condition of the assemblies, the blocking member being operable by a user to unblock the projection and to allow withdrawal of the projection from the opening so as to release the assemblies from one another. The invention of the cited document is not an autonomous tool and has not a practical use.

The invention described in document U.S. Pat. No. 6,260,444 B1, refers to a power tool for tightening and loosening threaded connectors has a housing, comprising a ratchet unit for turning an engaging element so as to turn a threaded connector engaged by the engaging element, a first hydraulic drive unit including a drive housing and a hydraulically movable driving element, a non-hydraulic drive unit including a drive housing and non-hydraulically moveable driving element, a first connection provided on the link housing and on the drive housing of the hydraulic drive unit and the non-hydraulic drive unit, so that alternatingly either the housing of the hydraulic drive unit or the housing of the non-hydraulic drive unit can be connected with the link housing, and a second connection for connecting the ratchet mechanism alternatingly with the driving element of the hydraulic drive unit or the driving element of the non-hydraulic drive unit, so that the driving element of the hydraulic drive unit and alternatingly the driving element of the non-hydraulic drive unit during its movement turns the ratchet mechanism of the link and thereby turns a threaded connector engaged by the engagement element of the link to be tightened or loosened.

BRIEF DESCRIPTION OF THE INVENTION

The present invention refers to a hydraulic wrench tool for high-torque tightening/loosening, which is achieved through an adjustable safety valve in order to keep the maximum torque that can be performed.

The hydraulic wrench tool of the present invention substantially consists of a main casing (1) which houses a series of components, whereby, upon manual displacement of a manual drive pump (52), the movement of a piston rod (43) is made. In a preferred embodiment, the tool is used for tightening/loosening flange nuts, for which the piston rod (43) of the hydraulic wrench is coupled to a receiving support (80) of a bearing wrench (90), and to a bearing support (97). In turn, the receiving support (86) of the bearing wrench is coupled to a bearing wrench (90). In view of the above, one single person is capable of manually tightening/loosening the nuts of a flange of great dimensions, for example the flanges used in oil facilities.

The present invention refers to a hand-operated hydraulic wrench for high torque tightening and loosening, comprising a main casing (1); a manual lever drive (52) coupled to the casing (1), the lever which is hollow and acts as hydraulic fluid accumulator (65) and contains a spring (53); a power piston (42) within the casing; wherein in order to move the power piston forward (42) it is pumped through the drive lever (52), which forces the hydraulic fluid to be displaced into a two-speed piston (20); a support (60) of the drive lever (52) which is coupled to the main casing (1) by an axis (59) and to the two-speed piston (20) through a spherical, two-head connecting rod (22); a piston sleeve (79), having two diameters for actuating the two-speed piston (20); a piston portion of greater diameter for low-pressure, fast forward movement, and a piston portion of lower diameter for high-pressure, slow forward movement; the manual lever drive (52) which causes the hydraulic fluid coming from the accumulator (65) to flow up to the smaller diameter, lower chamber of the sleeve (79) and from this point, the hydraulic fluid passes to a high-pressure chamber (49) driving the piston (42); and wherein in order to move the power piston (42) backwards, a rotation to the drive lever (52) in counterclockwise direction is applied, which causes the casing (1) to move towards the receiving support (86) of a bearing wrench (90), retrieving the piston (42), and causing the hydraulic fluid to be displaced into the accumulator (65).

The bearing wrench (90) is described and claimed in a patent application with the same title, which is filed concurrently to the present invention, so said bearing wrench (90) is not described in the present application.

BRIEF DESCRIPTION OF THE DRAWINGS

The present invention will become more evident from the following description when taken in connection with the accompanying drawings, wherein.

ELEMENTS OF THE TOOL

Figure 1:
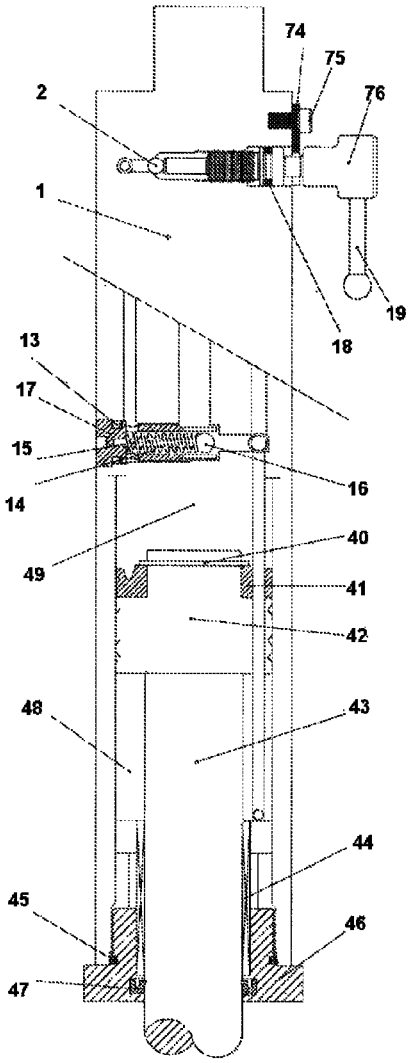
FIG. 1 shows a longitudinal cut of the main casing of the hydraulic wrench.
Figure 2:
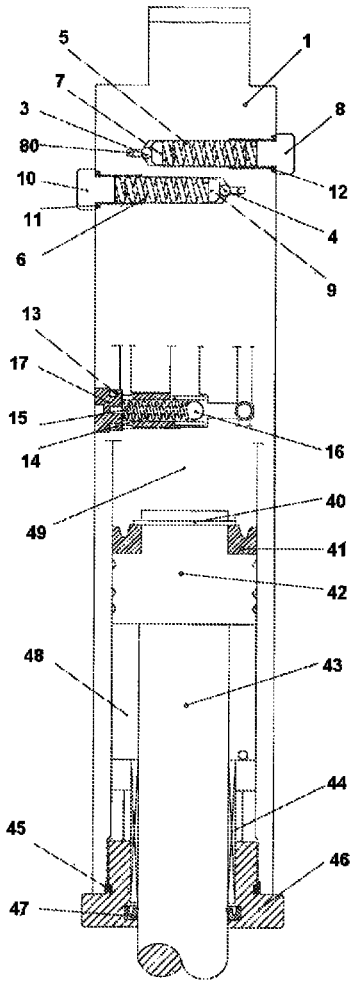
FIG. 2 shows a second longitudinal cut of the main casing of the hydraulic wrench.

1. Main casing
2. Piston back-flow ball valve
3. High-pressure ball valve
4. Low-pressure ball valve
5. High-pressure valve spring
6. Low-pressure valve spring
7. Low-pressure valve spring support
8. High-pressure valve cap screw
9. Low-pressure valve spring support
10. Low-pressure valve screw
11. Low-pressure valve seal
12. Low-pressure valve spring
13. Average valve seal
14. Average valve spring
15. Average valve detent
16. Average ball valve
17. Average valve cap screw
18. Return O-ring
19. Return lever
20. Two-speed piston
21. Piston connecting rod pin
22. Piston connecting rod
23. Low-pressure piston hub
24. High-pressure piston hub
25. Low-pressure ball valve
26. Low-pressure spring
27. Low-pressure valve butt
28. Low-pressure valve seal
29. Dual high/low pressure ball valve
30. High/low pressure valve detent
31. Low-pressure detent washer
32. High/low pressure valve spring
33. High/low pressure valve seal
34. High/low pressure valve cap screw
35. High-pressure ball valve
36. High pressure valve detent
37. High-pressure valve spring
38. High-pressure cap seal
39. High-pressure cap screw
40. Safety metal ring
41. Power piston collar
42. Power piston
43. Piston rod
44. Rod bushing
45. Rod cap seal
46. Rod cap
47. Rod collar
48. Low-pressure fluid chamber
49. High-pressure fluid chamber
50. Accumulator safety metal ring
51. Hydraulic fluid accumulator piston spring detent
52. Pump manual drive lever
53. Hydraulic fluid accumulator spring
54. Hydraulic fluid accumulator piston collar
55. Hydraulic fluid accumulator piston
56. Accumulator seal support
57. Hydraulic fluid accumulator filler screw
58. Accumulator filler ball valve
59. Drive support/lever axis
60. Drive lever support
61. Drive lever mounting latch
62. Drive lever latch screw
63. Drive lever latch screw spring
64. Drive lever latch screw bushing
65. Hydraulic fluid accumulator.
66. Drive lever-support axis seal
67. Drive lever-support axis seal
68. Drive lever-support axis seal
69. Drive lever-support axis seal
70. Latch screw for support-lever axis
71. Drive lever-support axis cap
72. Accumulator fluid gallery
73. entrance/exit fluid direction
74. Valve mounting latch
75. Latch screw
76. Back-flow valve screw
77. Low-pressure fluid gallery
78. High-pressure fluid gallery
79. Two-speed piston sleeve
80. Low-pressure fluid gallery
81. Casing rotating ring
82. Bearing chain
83. Receiving support mounting key
84. Mounting key spring
85. Mounting key lever
86. bearing wrench receiving support
87. Mounting key detent
88. Bearing wrench anchor bolts
89. Chain coupling hole
90. Bearing wrench
91. Bolt coupling piston/receiving support
92. Key side detents
93. Anchor bolt support/hydraulic wrench
94. Fin-receiving bolt support
95. Rotation fins
96. Coupling screw support/rotation fins
97. bearing support with closed hole
98. Support inner threading
99. End detent screw
100. Flange
101. Bearing wrench operated nut
102. Support bearing nut
103. Support nut end detent screw
104. Bolt supporting semicircular notches
105. Open support

DETAILED DESCRIPTION OF THE INVENTION

The tool has two differentiated functions. The first one consists of a manual wrench for tightening/loosening trueness of measurement in nuts, screws, bolts and similar, through the blockage of the bearing wrench with respect to the piston, whereby the tool causes the tool to be rigid as if it were only one body. The bearing wrench may return without the need of taking it out from the nut or screw. The hydraulic wrench tool of the present invention acts as a stationary wrench making a torque which is proportional to the force that the user is capable of applying.

The second function involves high torque tightening/loosening by the hydraulic wrench tool. The maximum capacity is determined by a discharge valve (safety) that may be tared to the set pressure in order to avoid damages to the equipment.

The hydraulic wrench of the present invention has a two-speed, simple effect piston, a first fast working speed for being able to have faster piston forward movements; and a second, slower higher pressure speed for making higher torques.

The supply system of the hydraulic wrench comprises a device whereby the wrench may operate in any position without the hydraulic supply having any supply interruptions. The pump manual drive lever also acts as a hydraulic fluid reservoir, which, along with a compression spring, keep the pump always supplied, regardless of its position with respect to the working plane.

The hydraulic fluid may be any liquid appropriate for being used in tools or hydraulic devices, for example hydraulic oil.

The main casing has a particular design in order to be able to quickly adjust the exchange of different bearing supports, and also to be able to adjust its filling point. Likewise, the interchangeable bearing exhibits a particular design in order to be able to perform the support in a quick and varied way.

As illustrated in FIGS. 1 to 5, in order to make the forward movement of the piston before starting the pumping, the mounting latch (61) is removed from the manual drive lever (52) rotating it towards the rear portion of the housing thereof. This latch has the function of blocking the drive lever (52) with the main support (1) thus forming a single body, and being able to use the hydraulic wrench as a stationary wrench such as a ratchet wrench.

The drive lever (61) mounting latch performs the function of blocking the drive lever support (60) avoiding rotation thereof. Thus, the main casing (1) and the drive lever support (60) are blocked thus forming one single body. For that purpose, the mounting latch (61) placed at the lever support (60) by a screw (62), which clamps a bushing (64) and guides a spring (63), tightens over the mounting latch (61). The mounting latch (61) is installed over the screw axis (62) being able to rotate 360° and when tightened by the spring (63) it is forced to be placed between the casing (1) and the support (60) (FIG. 40), being inserted in the only existing hole.

Figure 4:
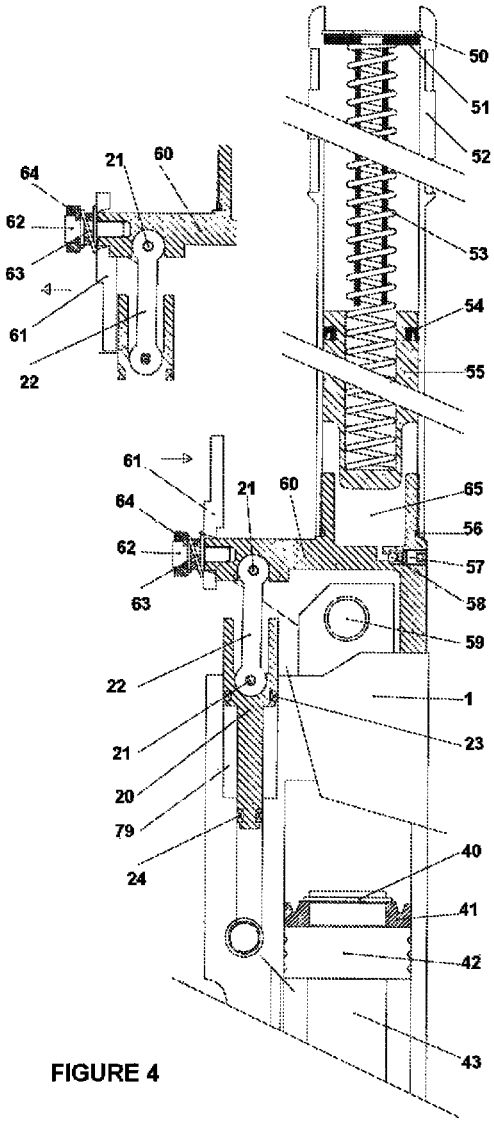
FIG. 4 shows a longitudinal cut of the hydraulic wrench main casing and the manual drive lever.
Figure 5:
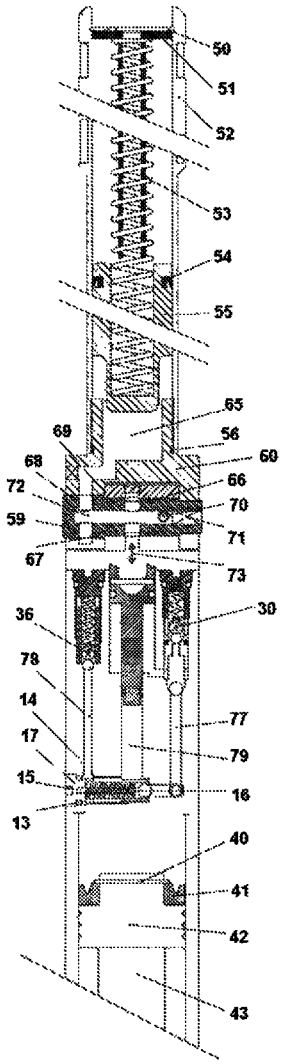
FIG. 5 shows a second longitudinal cut of the hydraulic wrench main casing and the manual drive lever.

On rotating the latch (61) manually over the screw axis (62) 360°, it reaches a point where it automatically abuts against the hollow, because it is the only one. If the mounting latch (61) is removed from the only existing hole, towards the rear portion, the lever (61)□ is unblocked, which enables its pumping function (FIG. 4).

In order to make the forward movement of the power piston (42), the return lever (19) that is coupled to the screw (76) must close the return ball valve (2). Once this is done, the pumping operation may begin through the drive lever (52), which in turn performs the function of hydraulic fluid accumulator (65), since the spring (53) pushes the piston (55) which forces the hydraulic fluid to be displaced to the two-speed piston (20) constantly supplying it. In this way, the hydraulic wrench may operate in any position without loosing the pump priming.

The accumulator safety metal ring (50) keeps the detent (51) spring guide (53), and in turn it acts as end piston detent (55) of the hydraulic fluid accumulator.

The hydraulic fluid accumulator piston (55) has a collar (54) for making the moisturetightness of the hydraulic fluid.

The manual drive lever (52) is coupled through a threaded coupling to the lever support (60), and the coupling is sealed by the moisturetight seal (56).

The drive lever support (60) is coupled to the main casing (1) by an axis (59). This axis has two galleries (72) for supplying the two-speed piston (20). It also receives the return hydraulic fluid. The galleries (72) are sealed by seals (66, 67, 68, 69), and by a screw (70) which secures the axis (59) to the casing (1).

The axis (59) of the support-drive lever has a closing cap (71). The gallery (73) supplies the two-speed piston (20), and also acts as return path in the process of the backward movement of the piston (42).

The drive lever support (60) has a threaded hole which houses a ball valve (58) which has the function of filling the accumulator (65), while closing the passage to the outside.

The support (60) is attached to the main casing (1) through the axis (59) which provides the joint necessary to perform the pumping.

The drive lever support (60) is coupled by a spherical, two-head connecting rod (22) through the pins (21); the top pin couples the support (60) with the connecting rod (22) and the lower pin couples the connecting rod (22) with the two-speed piston (20).

The pins (21) have the function of aiding in the action of moving the piston backwards (20). In the forward movement action of the connecting rod (22), the pins don't perform any function, since the head of the connecting rod (22) which is in contact with the piston (20) executes the support over this piston. The connecting rod (22) has two spherical heads, both in its connection with the piston (20) and in its connection with the drive lever support (60) so that it may oscillate in such a way that it always operates in a straight direction with regard to the piston sleeve (79), in this way the collars (23) and (24) will not be affected, which usually happens in the pump systems with the plunger fixed to directly to the drive lever.

The piston sleeve (79) has two diameters for conveniently actuating the two-speed piston (20). The piston (20) has a collar (23) for sealing the piston portion of greater diameter and a collar (24) of lower diameter that seals the piston portion of lower diameter. In this way, the piston portion of greater diameter is for low-pressure, fast forward movements, specially for avoiding clearances in support basis, and the lower-diameter portion for high-pressure, slower forward movements and therefore with a greater torque.

Figure 3:
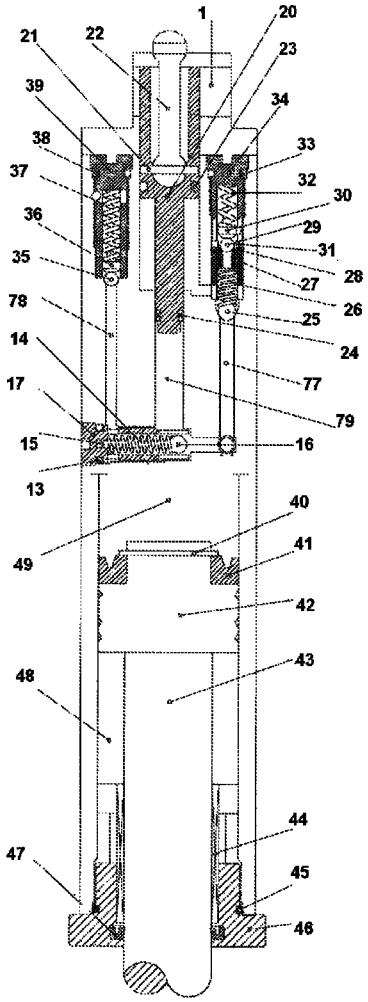
FIG. 3 shows a third longitudinal cut of the main casing of the hydraulic wrench.

As illustrated in FIG. 3, the piston connecting rod (22), upon moving upwards, forces the two-speed piston (20) to be displaced to its higher position, while the hydraulic fluid fills the piston (20) sleeve (79) through the hydraulic fluid accumulator (65), whose function is to supply at every moment the two-speed piston (20), so that the hydraulic priming is not lost, being this able to operate at any position with respect to the working plane.

The fluid coming from the accumulator (65) passes through the gallery (77) which opens the ball valve (25) causing the spring (26) to move backwards, passing the hydraulic fluid to the top chamber of greater diameter. At the same time, the hydraulic fluid passes through the gallery (77) that communicates the ball valve (16) thus opening it, compressing the spring (14) up to the detent (15), causing the hydraulic fluid to flow into the lower chamber of lower diameter of the sleeve (79).

The drive of the manual lever (52) makes the support (60), which is coupled by the connecting rod (22) to the piston (20), to exert pressure on the hydraulic fluid by closing the valve (25) and the valve (16), passing through the butt (27), opening the valve (29), which was closed by the spring (32) and the detent (30). At the same time, the hydraulic fluid passes through the screw cap (17) flowing through the gallery (79) and forcing the ball valve (16) to be closed, opening the ball valve (35), and raising the spring (37) detent (36). From this place, it passes to the high-pressure chamber (49) driving the power piston (42). The piston (42) has a seal collar (41) and a safety metal ring (40). The piston (42) is coupled to the rod (43) by a threaded coupling. The rod (43) is guided and sealed by the rod cap (46), which is threaded to the casing (1).

The rod cap (46) includes a friction bushing (44) and a seal collar (47) with the rod (43), and a seal (45) which holds the low-pressure fluid chamber (48).

When the piston (42) reaches the end of its stroke or maximum work pressure, the ball valve (3) opens up, acting as safety valve, and the hydraulic fluid goes to the accumulator (65).

The low-pressure ball valve (4) opens when the low-pressure gallery (77) reaches the low pressure pre-established by the low-pressure calibrating spring (6). This is done in order to have a faster piston (42) forward movement, that is, a higher supply flow to the pump. When the pre-established low pressure is exceeded, the high-pressure ball valve (3) acts, but it has lower flow and thus it is slower.

The ball valve (4) is calibrated at a low pressure (for example 100 bar) through the spring (6). The ball valve (3) is calibrated at a high pressure (for example 600 bar) through the spring (5). When the pressure exerted by the pump is higher than 600 bar, the ball valve (3) opens leading the hydraulic fluid to the return gallery (73), causing a low pressure to the system. In this manner, the piston (42) may not receive a pressure higher than that pre-established pressure through the spring (5), thus performing the function of a safety valve or overload prevention.

For the piston backward movement (42) the latch is first placed in the clamp housing. Then, the ball valve is opened (2), through the return lever (19) which is coupled to the screw (76). Upon moving backwards, the piston (42) forces the hydraulic fluid to be displaced through the gallery (73), proceeding through the gallery (72) and ending up in the hydraulic fluid accumulator (65), which also acts as reservoir, besides constantly supplying the pump.

Once the latch (61) is placed in the clamp housing and the ball valve (2), is open, the power piston (43) retrieval is done by simply rotating the manual drive lever in the direction of the chain's pull (82), that is by pulling the chain. The power piston (43) is a simple effect piston.

Figure 6:
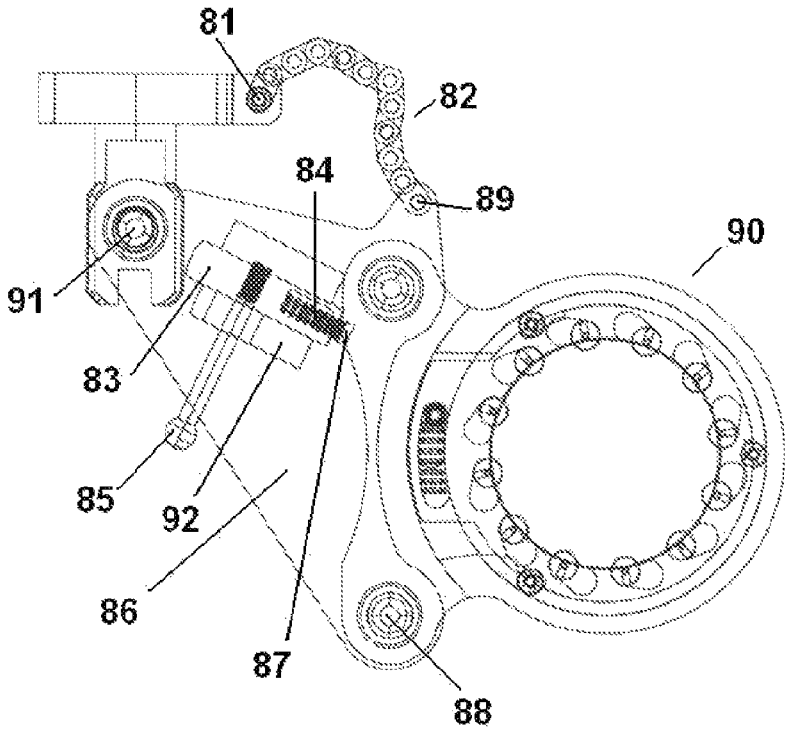
FIG. 6 shows the hydraulic wrench piston, the bearing wrench receiving support and the bearing wrench, at the beginning of the piston stroke.
Figure 7:
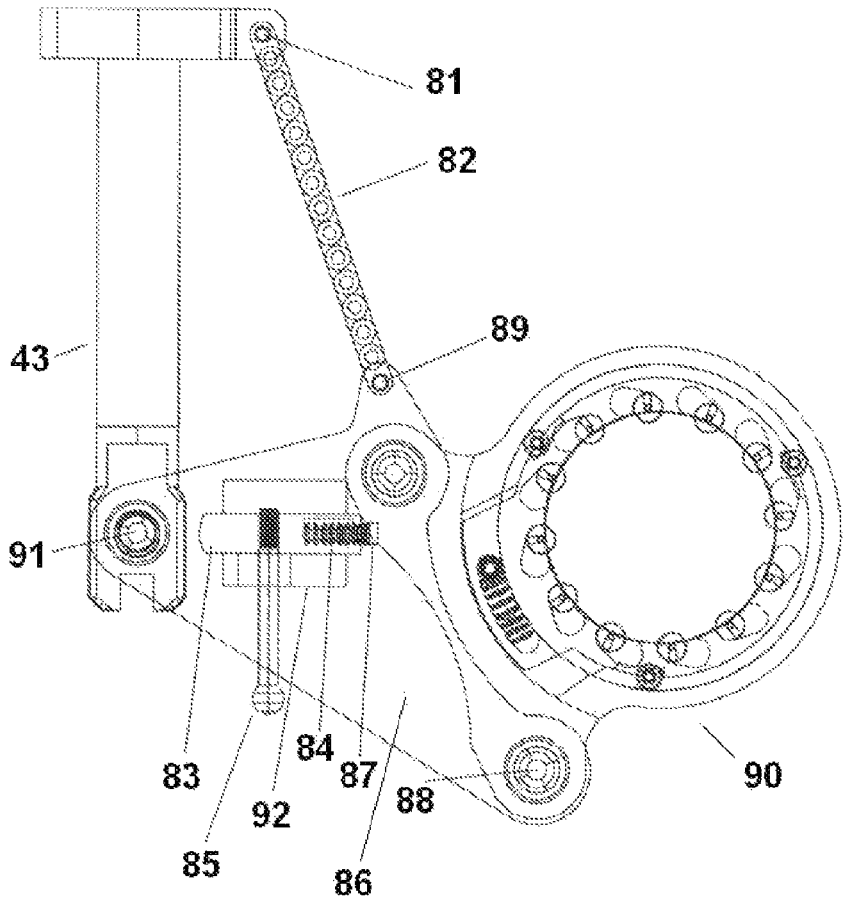
FIG. 7 shows the hydraulic wrench piston, the bearing wrench receiving support and the bearing wrench, at the end of the piston stroke for collecting the piston.
Figure 8:
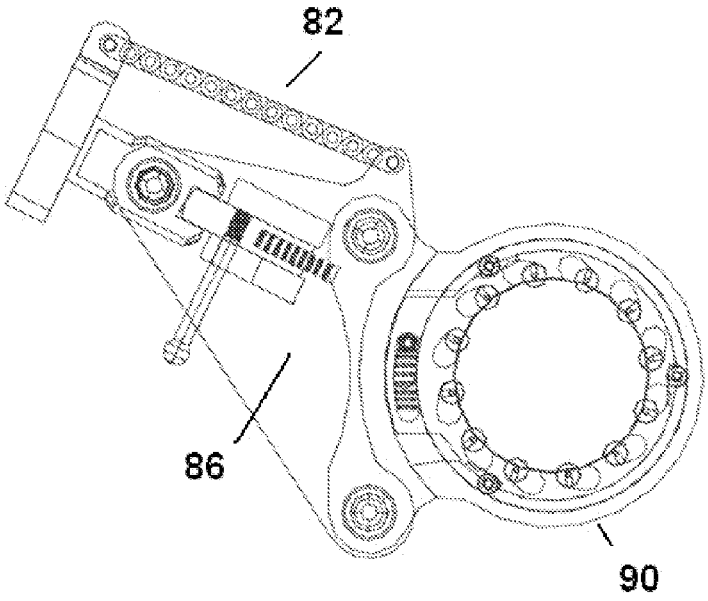
FIG. 8 shows the hydraulic wrench piston, the bearing wrench receiving support and the bearing wrench, at the end of the piston stroke capture.

As shown in FIGS. 6 to 8, when the chain (82) is coupled to the rotating ring (81) of the casing (1) at an end, and at the other end is coupled to the hole (89) of the receiving support (86) of the bearing wrench (90), the counterclockwise turn power applied to the lever (52) causes the casing (1) to mover towards the receiving support (86) of the bearing wrench (90), collecting the piston (43), and causing the hydraulic fluid to be moved to the accumulator (65).

The chain (82) has the function of supporting point in order to be able to collect the piston rod (43) once the stroke has ended, due to the fact that the piston is a simple effect piston.

In FIG. 6, the piston rod (43) is collected, ready for starting its stroke. When it moves forward and reaches its maximum stroke as in FIG. 7, the chain (82) is extended at its maximum length.

In order to retrieve the piston rod (43), the ball valve (2) must be open so that when the rod (43) moves backwards, the hydraulic fluid may go towards the accumulator (65) and also the wrench is stretched out.

Once the valve (2) is open, the main casing (1) shall be rotated so that the bearing support (97) (see FIG. 9) stops abutting against the nut (102), and so that the bearing support (97) may be taken out from the nut. Once the bearing support (97) is taken out of the nut, and the mounting latch (61) of the drive lever is in place, the whole wrench is rotated counterclockwise (if it is being loosened) (FIG. 6).

Upon rotation of the main casing (1), it moves forward into the bolt (91) position which acts as detent so that the piston rod (43) doesn't move. The chain (82) is coupled at an end to the receiving support (86) of the bearing wrench (90), and it is coupled at the other end to the rotating ring (81) which is coupled to the main casing (1). While the casing is rotated (1), the chain (82) forces the rod (43) to be inserted in the interior of the casing (1), that is, the sleeve. In FIG. 8, it may be seen that once the wrench has finished rotating (some 90° counterclockwise), the piston rod (43) slot is inserted in the mounting key (83), in this moment the casing (1), the receiving support of the bearing wrench (86) and the bearing wrench (90) constitute one single body, which may act as a ratchet wrench in order to finish the loosening of the nut.

FIG. 6 illustrates the beginning of the piston stroke; FIG. 7 illustrates the end of the piston stroke and the beginning of the piston retrieval; and FIG. 8 illustrates the end of the piston retrieval.

Figure 9:
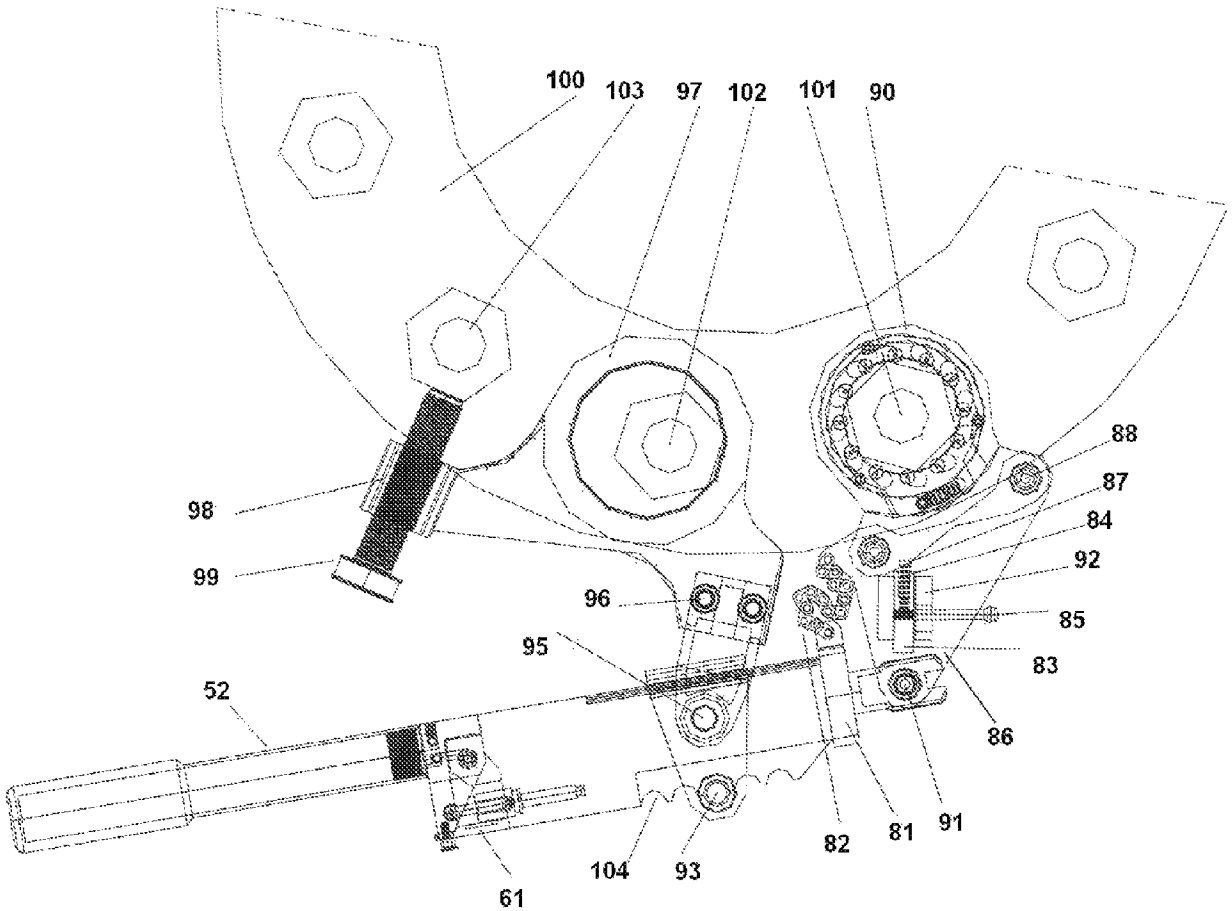
FIG. 9 shows the hydraulic wrench, the bearing wrench support, the bearing wrench and the bearing support, mounted in a flange assembly.
Figure 10:
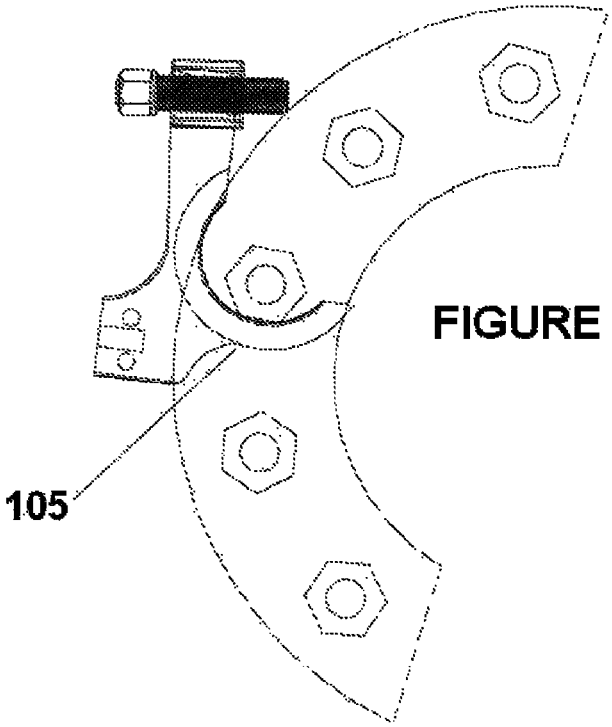
FIG. 10 shows an open bearing support.
Figure 11:
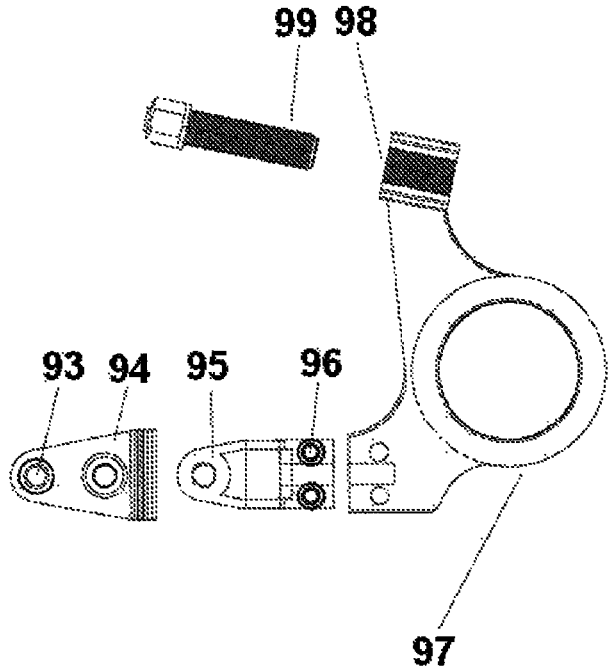
FIG. 11 shows a closed bearing support.

From the Figures it can be understood that the bearing wrench is inserted in a nut, for example the nut (101) of FIG. 9, in order to be able to see that the position is stationary, that is, if the casing is rotated, the nut acts as support so that the piston is unable to move forward, and stays static, and the main casing of the wrench is the one which moves forward. Obviously, if the nut is excessively loosened, the piston will rotate until the side bearing support abuts against one of the side nuts.

When the piston has been completely retrieved, the piston hole (43) remains in the same action line of the lever arm (83), which through the thrust of the spring (84) automatically enters into the piston hole (43), thus blocking it. In that precise moment, the hydraulic wrench becomes a stationary ratchet wrench of great dimensions, in order to make manual approximation tightening/loosening, applicable specially to screws or nuts of great dimensions, for example in a flange, where the threads pose difficulties in nut threading such as oxidation, bumps, expansion, etc.

In order to switch the ratchet-type manual wrench to hydraulic wrench, the lever (85) is moved into the inner part of the receiving support (86) of the bearing wrench (90), while applying a small clockwise rotation so that the key (83) remains outside of the piston hole (43). The lever (85) is connected to the key (83) by a threaded hole. The key (83) has a hole for housing the spring (84) acting as a guide. The key (83) is laterally guided by two detents (92), and another detent (87) at its rear portion that doesn't allow the exit of the spring (84).

Two bolts (88) couple the bearing wrench (90) with the receiving support (86). The bolt (91) couples the power piston (43) with the receiving support (86) of the bearing wrench (90). The two bolts (88) also have the function of performing the switch to bearing wrench (90) in a fast way for another of different size.

When the tool is used as hydraulic wrench in order to tighten or loosen a screw or nut in a flange, a bearing support (97) is required. This bearing support (97) has an inner thread (98) in order to be able to house an end detent screw (99). The bearing support (97) is interchangeable thanks to two screws (96) which secure the two rotation fins (95), which in turn are coupled to the support with rotation bolts (94). The bolt support (94) has a through hole in order to be able to insert the bolt (93) whose function is to secure the bearing support (97) to the hydraulic wrench.

The bolt (93) may fit in any of the support semicircular notches (104) that the hydraulic wrench has, the most appropriate bolt may be selected regarding the supporting point nut. The two fins (94) have the function of being able to rotate the support in both directions in order to seek the most appropriate supporting point. The end detent screw (98) may be threaded or unthreaded depending on the place where the second bearing nut is located. A second support is needed, otherwise the bearing support (97), being circular in the portion which dimensions the bearing nut (102), would be rotating at the same time as the bearing wrench (90), without producing any type of tightening or loosening in the nut.

In FIG. 9, the nut (101) is the one that is loosened through the bearing wrench (90), the nut (102) supports the bearing support (97), and the nut (103) makes the supporting point of the end detent screw (99).

The bearing support (97) has a hole where the nut is located (102), instead the bearing support (105) is open and the end detent screw (99) remains beneath the average height of the bearing support (97), so instead of making the support with a nut, the end detent screw (99) makes the support over the flange tangent (100). The two screws (96) may secure the bearing support (97), the bearing support (105) or any other which needs to adjust to different types of flanges. The switch will be quick, since only the two screws (96) must be loosened.

In order to loosen a nut, first the bearing wrench (90) is placed in the nut that is going to be loosened; afterwards the best possible supporting point is sought. To that end, many variations are available; first, the bolt (93) may be placed in one of the various semicircular notches provided in the hydraulic wrench, moving the support away from or near (94) the bolt (91) which is the one that transmits power, through the support (86) to the bearing wrench (90). In second place is the variation that supplies the fins (95) rotation, through the bearing bolts (94), and finally the end detent screw (99) which provides variation of the second support, threading or unthreading the end detent screw (99), in the threaded hole (98) of the bearing support (97).

In order to make a tightening the hydraulic wrench is simply rotated and operated in the same way.

Therefore, those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A hand-operated hydraulic wrench for high torque tightening and loosening, comprising:

a main casing (1);

a manual drive lever (52) coupled to the casing (1), the lever is hollow and acts as hydraulic fluid accumulator (65) and contains a spring (53);

a power piston (42) within the casing;

wherein in order to make the power piston (42) advance forwards, it is pumped through the drive lever (52), which forces the hydraulic fluid to be displaced into a two-speed piston (20);

a support (60) of the drive lever (52) which is coupled to the main casing (1) by an axis (59) and to the two-speed piston (20) through a spherical, two-head connecting rod (22);

a piston sleeve (79), having two diameters for actuating the two-speed piston (20); a piston portion of greater diameter for low-pressure, fast forward movement, and a piston portion of lower diameter for high-pressure, slow forward movements;

the manual lever (52) drive causes the hydraulic fluid from the accumulator (65) to flow to the lower chamber of lower diameter of the sleeve (79) and from this place the hydraulic fluid passes into a high-pressure chamber (49) driving the piston (42); and wherein in order to make the backward movement of the power piston (42) a rotation of the drive lever (52) is applied in counterclockwise direction, which causes the casing (1) to move forward to a receiving support (86) of a bearing wrench (90), retrieving the piston (42), and causing the hydraulic fluid to be displaced to the accumulator (65).

2. The hand-operated hydraulic wrench for high torque tightening and loosening of claim 1, wherein the hydraulic wrench may be used as a stationary ratchet wrench, before or after pumping, removing the mounting latch (61) of the manual drive lever (52), rotating it into the rear portion of its housing, whereby the drive lever (52) is blocked with the main support (1) thus forming one single body.

3. The hand-operated hydraulic wrench for high torque tightening and loosening of claim 1, wherein in order to move forward the power piston (42), a return lever (19) closes a return ball valve (2), and upon pumping through the drive lever (52), the spring (53) pushes a piston (55), which forces the hydraulic fluid to be displaced into the two-speed piston (20) constantly supplying it.

4. The hand-operated hydraulic wrench for high torque tightening and loosening of claim 1, wherein the axis (59) has two galleries (72, 73) for supplying the two-speed piston (20), which also receives the return hydraulic fluid; the gallery supplies the two-speed piston (20), and also acts as return path in the piston return process (42).

5. The hand-operated hydraulic wrench for high torque tightening and loosening of claim 1, wherein the support (60) of the drive lever (52) has a threaded hole which houses a ball valve (58) which performs the function of filling the accumulator (65) and which in turn closes the passage from the outside.

6. The hand-operated hydraulic wrench for high torque tightening and loosening of claim 1, wherein the support (60) is coupled to the main casing (1) through an axis (59) which provides sufficient joint to perform the pumping action.

7. The hand-operated hydraulic wrench for high torque tightening and loosening of claim 1, wherein the hydraulic fluid in its accumulator path (65) to the high-pressure chamber (49) passes through a gallery (77), which opens a ball valve (25) causing a spring (26) to move backwards, and causing the hydraulic fluid to pass through the greater diameter top chamber, while the hydraulic fluid passes through the gallery (77) which communicates a ball valve (16) by opening it, compressing a spring (14) up to a detent (15), and making the hydraulic fluid flow up to the lower diameter, high-pressure chamber (4), of the sleeve (79).

8. The hand-operated hydraulic wrench for high torque tightening and loosening of claim 1, wherein the drive of the manual lever (52) forces the support (60), which is coupled through the connecting rod (22) to the piston (20), to press on the hydraulic fluid by closing the valve (25) and the valve (16), by passing through the butt (27), by opening the valve (29), which was closed by a spring (32) and a detent (30); at the same time the hydraulic fluid is passing through the screw cap (17) flowing through the gallery (79) and forcing to close the ball valve (16), opening the ball valve (35), and raising the spring (37) detent (36); from this point, the hydraulic fluid stops a high-pressure chamber of greater diameter, driving the power piston (42) which is coupled to a rod (43).

9. The hand-operated hydraulic wrench for high torque tightening and loosening of claim 1, wherein, when the piston (42) reaches the end of the stroke or maximum working pressure, a ball valve (3) opens, acting as safety valve, the hydraulic fluid going into the accumulator (65).

10. The hand-operated hydraulic wrench for high torque tightening and loosening of claim 1, wherein a low-pressure ball valve (4) is open when the low-pressure gallery (77) reaches a pre-established low pressure by a low-pressure calibration spring (6), whereby a faster forward movement of the piston (42) is reached.

11. The hand-operated hydraulic wrench for high torque tightening and loosening of claim 1, wherein, when the pre-established low pressure is exceeded, the high-pressure ball valve (3) acts, but it is of lower flow and therefore slower.

12. The hand-operated hydraulic wrench for high torque tightening and loosening of claim 1, wherein for the piston backward movement, (42) the latch (61) is placed in the clamp housing, opening a ball valve (2), through the return lever (19), the piston backward movement (42) forces the hydraulic fluid to be displaced through the gallery (73), going through the gallery (72) and finishing in the hydraulic fluid accumulator (65), and rotating the manual drive lever (52) in the direction of the chain pull (82).

13. The hand-operated hydraulic wrench for high torque tightening and loosening of claim 12, wherein the chain (82) is coupled to a rotatory ring (81) of the casing (1) at an end, and at the other end to a receiving support (86) hole (89) of the bearing wrench (90), whereby the counterclockwise turn power applied to the lever (52) causes the casing (1) to move towards the receiving support (86) of the bearing wrench (90), retrieving the piston (42), and causing the hydraulic fluid to be displaced into the accumulator (65).

14. The hand-operated hydraulic wrench for high torque tightening and loosening of claim 12, wherein the hydraulic fluid is hydraulic oil.

15. The hand-operated hydraulic wrench for high torque tightening and loosening of claim 1, further comprising a bearing support (97) which has an inner threading (98) for housing an end detent screw (99).

16. The hand-operated hydraulic wrench for high torque tightening and loosening of claim 15, wherein the bearing support (97) is interchangeable through two screws (96) which secure them to two rotation fins (95), which in turn are coupled to a support with rotation bolts (94).

17. The hand-operated hydraulic wrench for high torque tightening and loosening of claim 16, wherein the support with bolts (94) has a through hole for inserting a bolt (93), whose function is to secure the bearing support (97) to the hydraulic wrench.

18. The hand-operated hydraulic wrench for high torque tightening and loosening of claim 17, wherein the bolt (93) may fit in any of the support semicircular notches (104) of the hydraulic wrench.

19. The hand-operated hydraulic wrench for high torque tightening and loosening of claim 16, wherein the two fins (95) perform the function of rotating the support to both sides in order to seek the most adequate supporting point.

20. The hand-operated hydraulic wrench for high torque tightening and loosening of claim 15, wherein the end detent screw (99) may be threaded or unthreaded depending on the place where a second bearing nut is located.

21. The hand-operated hydraulic wrench for high torque tightening and loosening of claim 15, wherein the bearing support (97) is closed and has a hole where a bearing nut (102) is located.

22. The hand-operated hydraulic wrench for high torque tightening and loosening of claim 15, wherein the bearing support (105) is open and the end detent screw (99) remains underneath the average height of the bearing support (105), whereby the end detent screw (99) makes support on the flange tangent (100).

* * * * *